US007631698B2

(12) United States Patent
Miller et al.

(10) Patent No.: US 7,631,698 B2
(45) Date of Patent: Dec. 15, 2009

(54) DEPTH CONTROL IN COILED TUBING OPERATIONS

(75) Inventors: Charles Miller, Katy, TX (US); Ivan Hlestov, Sugar Land, TX (US); Frank F. Espinosa, Richmond, TX (US); Michael G. Gay, Rock Springs, WY (US); John R. Lovell, Houston, TX (US)

(73) Assignee: Schlamberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/424,660

(22) Filed: Jun. 16, 2006

(65) Prior Publication Data

US 2006/0289172 A1 Dec. 28, 2006

Related U.S. Application Data

(60) Provisional application No. 60/692,153, filed on Jun. 20, 2005.

(51) Int. Cl.
*E21B 29/00* (2006.01)

(52) U.S. Cl. ..... 166/382; 166/255.1; 166/55.7

(58) Field of Classification Search ..... 166/212, 166/382, 255.1, 255.2, 55.7
See application file for complete search history.

(56) References Cited

U.S. PATENT DOCUMENTS

| | | | | |
|---|---|---|---|---|
| 3,344,862 | A * | 10/1967 | Conrad | 166/216 |
| 4,346,761 | A * | 8/1982 | Skinner et al. | 166/206 |
| 4,819,728 | A * | 4/1989 | Lafitte | 166/298 |
| 5,031,719 | A * | 7/1991 | Baria et al. | 181/122 |
| 5,575,331 | A * | 11/1996 | Terrell | 166/55 |
| 6,135,206 | A * | 10/2000 | Gano et al. | 166/297 |
| 6,394,184 | B2 | 5/2002 | Tolman | |
| 6,520,255 | B2 | 2/2003 | Tolman | |
| 6,543,538 | B2 | 4/2003 | Tolman | |
| 6,564,868 | B1 * | 5/2003 | Ferguson et al. | 166/298 |
| 6,957,701 | B2 | 10/2005 | Tolman | |
| 7,059,407 | B2 | 6/2006 | Tolman | |
| 2001/0050172 | A1 | 12/2001 | Tolman | |
| 2002/0007949 | A1 | 1/2002 | Tolman | |
| 2002/0092650 | A1 | 7/2002 | Tolman | |
| 2003/0051876 | A1 | 3/2003 | Tolman | |
| 2005/0178551 | A1 | 8/2005 | Tolman | |

FOREIGN PATENT DOCUMENTS

| | | |
|---|---|---|
| RU | 2165007 | 4/2001 |
| SU | 170889 | 6/1965 |
| SU | 901467 | 1/1982 |
| SU | 1583587 | 8/1990 |

* cited by examiner

*Primary Examiner*—Shane Bomar
(74) *Attorney, Agent, or Firm*—Rodney Warfford; David Cate; Robin Nava

(57) ABSTRACT

A depth control system for maintaining a tubing conveyed tool in a desired location in a cased wellbore during wellbore operations performed with the tool includes a bottom hole assembly carried by a tubing, the bottom hole assembly including a tool and an anchoring device. A method for maintaining a tool at a desired depth in a cased wellbore while performing wellbore operations with the tool includes the steps of conveying a tool and an anchoring device on a tubing to a desired depth in a wellbore having a casing, operating the tool to perform a wellbore operation and actuating the anchoring device to engage the casing and maintain the tool at the desired depth.

18 Claims, 2 Drawing Sheets

DEPTH CONTROL IN COILED TUBING OPERATIONS

RELATED APPLICATIONS

This application claims the benefit of U.S. Provisional Patent Application No. 60/692,153 filed Jun. 20, 2005.

FIELD OF THE INVENTION

The present invention relates in general to conducting coil tubing operations in wellbores and more specifically to maintaining depth control during the operations.

BACKGROUND

In a cased oil or gas well, the hydrocarbon in the formation can be accessed by perforating the casing with a high-energy shape charge or by abrasively cutting holes or slots in the casing with a jetting tool. In the latter application, slurry is pumped down a tubular and through a small jetting nozzle. This abrasive mixture exits the jetting tool at a high velocity, impinges on the casing wall and abrades or cuts holes in the casing. Abrading holes in casing is performed by technologies such as the Abrasijet™ tool introduced by Schlumberger.

Conventional jetting assemblies are lowered on drillpipe. Some drillpipe conveyed jetting assemblies include slip-type mechanisms to limit the vibration of the bottom hole assembly (BHA) in the wellbore, however, these slips are not designed to stop axial movement of the BHA in the wellbore.

Recently, jetting tools have been attached to coiled tubing and this has introduced new challenges. The primary issue facing coiled tubing deployed jetting is depth control. Knowing exactly where the BHA is during a job and maintaining the BHA in a desired location during operations is difficult. The coiled tubing length is susceptible to axial compression and tension forces, internal pressure, flow rate down the tubing or annulus, high temperatures, coiled tubing friction with casing wall, etc. During jet cutting and other wellbore operations, many of the forces mentioned act on the tubing and BHA. The result is that the overall length of the coiled tubing changes and the tool moves during the operation. Movement of the jetting tool during cutting operations results in slots or incomplete cutting of the casing. In a worst-case scenario, the jetting tool can move as much as ten ft (3 m), which can be enough to jet holes into the wrong formation behind the reservoir.

Conventional techniques for maintaining depth control of coiled tubing include devices that monitor how much tubing has been fed into the wellbore, however these techniques do not provide the extent of buckling, stretch, etc. Enhancements to these methods include the step of using forward modeling or knowledge of the tubing properties to predict this buckling, stretch, etc.

Depth control during abrasion cutting has conventionally included the step of using a mechanical casing collar locator (CCL) that activates a hammer to "strike" the coiled tubing each time the CCL crosses a casing collar. The sound of the hammer striking the coil can (sometimes) be picked up by listening to the coil at the surface.

Therefore, there is a desire to provide methods and systems for controlling the depth of a coiled tubing conveyed tool during wellbore operations.

SUMMARY OF THE INVENTION

Accordingly, depth control systems and methods for maintaining a tubing conveyed tool at a desired depth in a cased wellbore during wellbore operations is provided. An embodiment of a depth control system for maintaining a tubing conveyed tool in a desired location in a cased wellbore during wellbore operations performed with the tool includes a bottom hole assembly carried by a tubing, the bottom hole assembly including a tool and an anchoring device.

An embodiment of a method for maintaining a tool at a desired depth in a cased wellbore while performing wellbore operations with the tool includes the steps of conveying a tool and an anchoring device on a tubing to a desired depth in a wellbore having a casing, operating the tool to perform a wellbore operation and actuating the anchoring device to engage the casing and maintain the tool at the desired depth.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
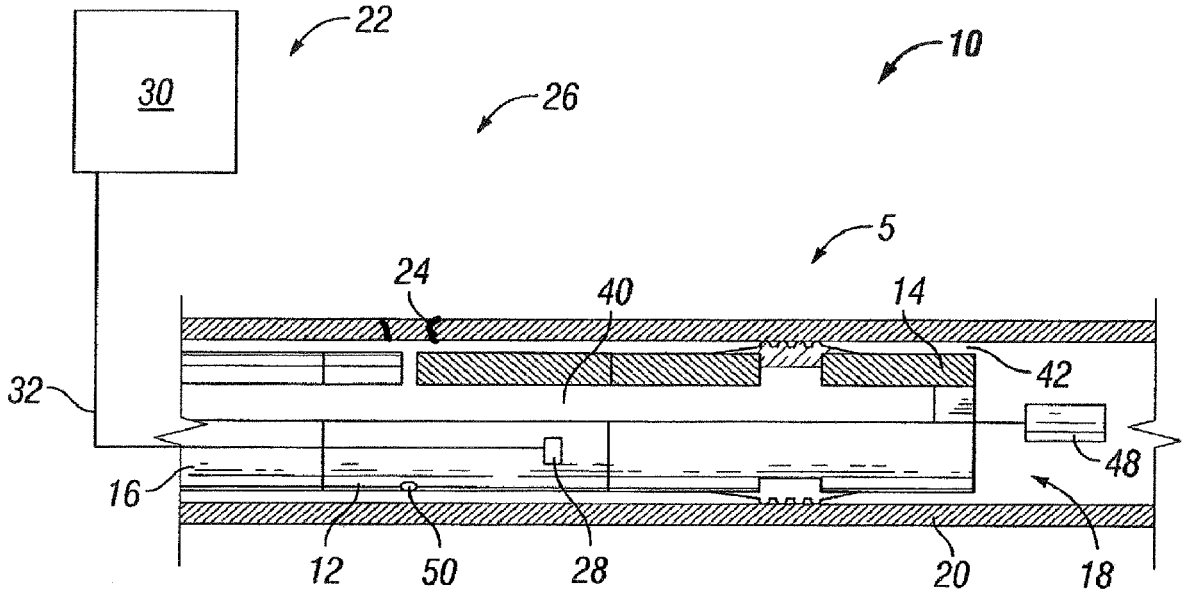
FIG. 1 is a perspective view of an embodiment of the depth control system of the present invention.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

The present invention relates to controlling and maintaining the depth of a tubing conveyed tool during wellbore operations. The present invention is described herein in relation to jet cutting and stimulation operations, however, it should be recognized that the depth control systems and methods of the present invention may be utilized in conjunction with other wellbore operations. It should further be noted, that although the invention is particularly suited for coiled tubing operations, the system and method may be utilized with other tubulars including drillpipe.

FIG. 1 is a perspective view of an embodiment of the depth control system of the present invention, generally denoted by the numeral 10. Depth control system 10 includes a tool 12 and anchoring mechanism 14 conveyed by tubing 16 into a wellbore 18 having casing 20. Tool 12 and anchoring mechanism 14 are referred to herein as the bottom hole assembly (BHA) and generally designated by the numeral 5. Depth control system 10 may further include a depth management system 22.

A first step in conducting wellbore operations is to position tool 12 at the desired depth in wellbore 18. In the illustrated embodiment, it is desired to cut hole 24 proximate formation 26 and then to stimulate formation 26 for production or injection. Depth management system 22 is utilized to accurately convey tool 12 via tubing 16 to the desired depth at formation 26 by identifying the location of BHA 5 in wellbore 18. In one embodiment of the present invention, depth management system 22 includes one or more sensors 28 carried by BHA 5 operationally connected to a surface unit 30 for displaying depth readings of BHA 5. Sensor 28 may be connected to surface unit 30 via a cable 32, such as but not limited to optical fibers, monocable or heptacable. Sensor 28 may be operationally connected to surface unit 30 via wireless telemetry. Sensors 28 may further be adapted to measure and provide additional data, including pressure, temperature and BHA 5 telemetry information such as axial and azimuthal data to surface unit 30. It should further be noted that surface unit 30 may be in operational connection with tool 12 and/or anchoring mechanism 14 to provide electronic control of their operation.

Anchoring mechanism 14 is adapted to engage casing 20 so as to limit or prevent longitudinal movement of BHA 5 in wellbore 18 when engaged. Examples of anchoring mechanisms 14 include (i) pressure, flow, or mechanically activated gripping slips that engage casing 20 during tool 12 operation or (ii) spring, pressure, flow or mechanically activated drag blocks that simply use friction to hold tool 12 in place during operation of tool 12.

Figure 2A:
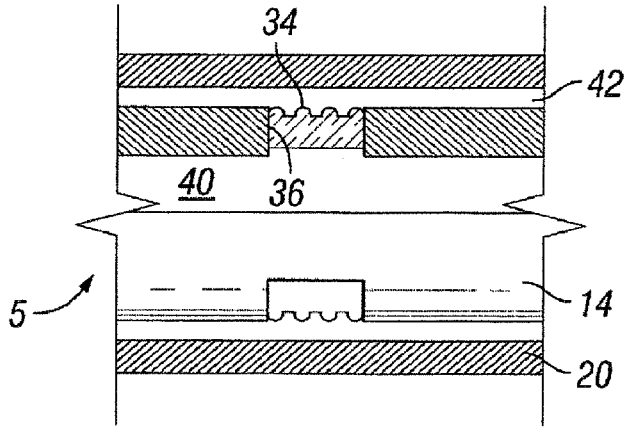
FIG. 2A is perspective view of an anchoring device of the present invention in a retracted position.
Figure 2B:
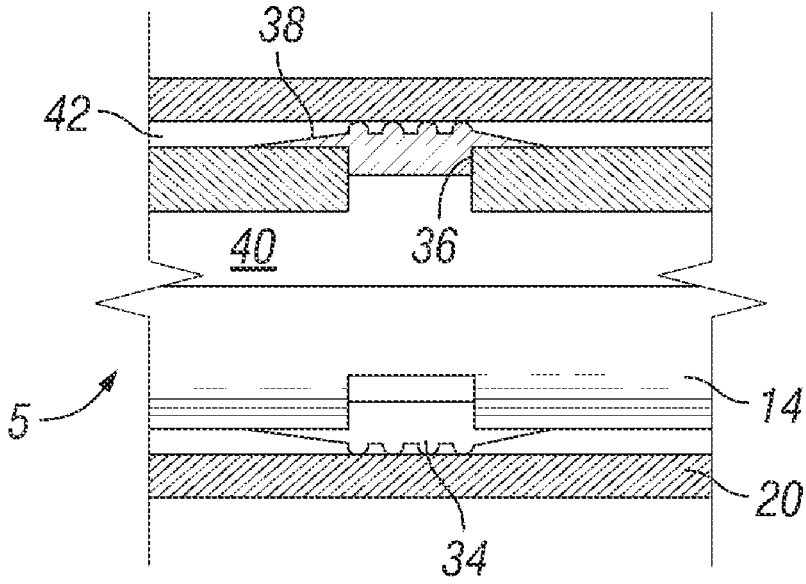
FIG. 2B is a perspective view of the anchoring device of FIG. 2A in the extended or engaged position.

Referring now to FIGS. 2A and 2B, anchoring mechanism 14 is illustrated as a button type slip. Anchoring mechanism 14 includes a button slip 34 moveable between a retracted position shown in FIG. 2A and an extended or engaged position, shown in FIG. 2B. Anchoring mechanism 14 may further including shoulders 36 extending from button slips 34 and a matable lip 38 to limit the extension of button slip 34.

Operation of button slips 14 is further described with reference to FIGS. 1, 2A and 2B. When wellbore operations are commenced, fluid, such as an abrasive fluid, is pumped through the internal bore 40 of coiled tubing 16, tool 12 and anchoring mechanism 14. As the pressure increases in bore 40 over the pressure in the annulus 42 between BHA 5 and casing 20, button slip 34 extends outward from BHA 5 and engages casing 20. When the wellbore operations cease and the pressure in bore 40 equalizes with pressure in annulus 42, button slip 34 is biased back to the retracted position of FIG. 2A.

Figure 3:
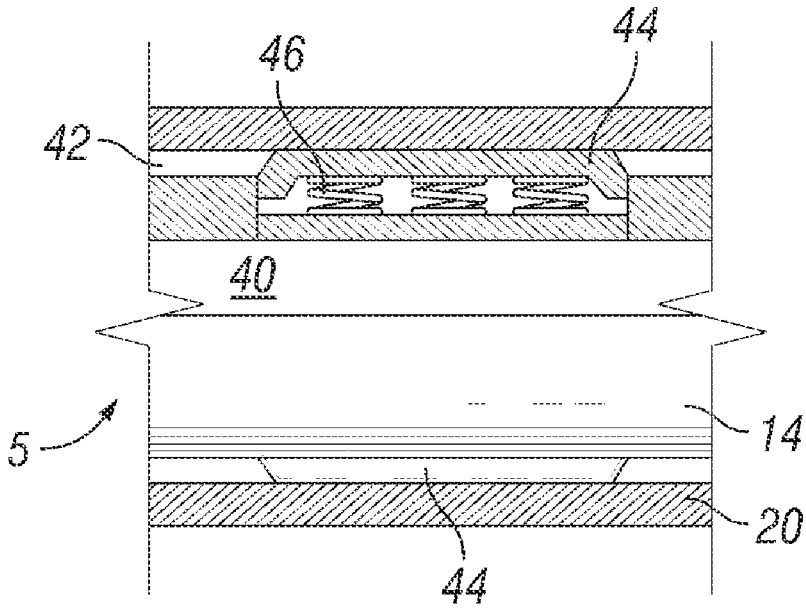
FIG. 3 is a perspective view of another embodiment of an anchoring device of the present invention.

FIG. 3 is a perspective view of another embodiment of anchoring device 14. In this embodiment, anchoring device 14 includes a drag block 44. Drag block 44 is extended from anchoring device 14 and engages casing 20. Drag block 44 utilizes friction to minimize the movement of BHA 5. Drag block 44 may be actuated via pressure in bore 40 and/or by biasing means such as, but not limited to, springs 46.

Depth control of BHA 5 may further include the step of adjusting or controlling the location of tool 12 to enable adjustment of its axial location or its azimuthal location. As previously indicated, depth management system 22 may provide BHA 5 telemetry information and operator control of tool 12 operation. In the case of adjusting the axial location of a jet tool 12, an injector control may be utilized. In the case of adjusting the azimuthal location, a gravity-sensor, such as a hanging weight 48 may be added to BHA 5 and the jets 50 oriented with respect to hanging weight 48. A combination of these techniques could be used to create spirals, ovals, etc in casing 20.

Downhole measurement data can be obtained and transmitted during the stimulation via depth management system 22 using optical telemetry, wireless telemetry and telemetry along a cable. A preferred embodiment is optical telemetry, in which case optical devices exist to transmit temperature and pressure. Downhole pressure can also be used to derive flow-rate, foam-quality and viscosity or dedicated sensors can be used.

In an embodiment of the present invention, formation 26 is stimulated utilizing hydraulic fracturing via tool 12. Measured data, via sensors 28, is pressure and the method includes the step of monitoring the downhole pressure to give an indication of at least one of: screen-out, radial fracture extent, vertical fracture extent, and perforation friction. The measured data can be transmitted up cable 32 and plotted on a chart of log-time versus log-pressure. If the slope of this approaches one then this is indicative of a screen-out, wherein the formation cannot absorb any more proppant. In such a case, the pumping operation needs to be quickly switched to stop wellbore 18 from completely filling with sand. Having a downhole measurement gives many minutes of advance warning. Other slopes on the log/log plot are indicative of either the fracture growing radially or vertically.

During wellbore operations such as jetting, downhole measurement data can be transmitted to optimize the procedure, e.g., adjusting the flow rate to maintain a constant pressure drop across jets 50 in cutting operations. As the abrasive cutting material passes through jets 50, the jets will lower the impinging pressure on casing 20. By monitoring this, the flow-rate can be increased in accordance so as to maintain a constant pressure on the casing surface, resulting in a cleaner and faster cut hole 24.

The present invention covers both pumping down a tubular and into annulus 42 between tubular 16 and casing 20. For example, coiled tubing 16 can be introduced into wellbore 18 and stimulation fluid is pumped down annulus 42.

Alternatively, the stimulation fluid can be pumped down coiled tubing 16. In older wells the stimulation fluid is forced into jetted holes 24 via a zonal isolation apparatus (not shown) straddling those holes. Typically such apparatus include cups and inflatable packers.

Once holes 24 have been jetted and reservoir formation 26 stimulated, the reservoir will be allowed to flow-back, sometimes kicked off with nitrogen to initiate the flow. In the case of hydraulic fracturing, this initiation can allow a significant amount of sand to return into the well-bore. This sand coming at high-speed through the jetted holes will then itself act as a sort of abrasive jet and can cut holes in the tubular used to convey the bottom hole assembly. Consequently, it is a preferred feature of this method to pull the tubular up above the incoming fluid, so as to avoid abrading that tubular.

From the foregoing detailed description of specific embodiments of the invention, it should be apparent that a depth control system and method for maintaining and controlling a tubing conveyed tool during wellbore operations that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A depth control system for maintaining a tool in a desired location in a cased wellbore during a fluid pressure wellbore operation performed with the tool, the system comprising:

a tubing connected to a bottom hole assembly to deploy the tool to the desired location, the bottom hole assembly comprising:

a sensor to obtain data in the cased wellbore, the sensor operationally connected with a surface unit to transmit data from the sensor to the surface unit to identify said desired location of said tool in the wellbore;

an anchoring device operable to engage the cased wellbore to maintain said tool in said desired location; and fluid transmitted from a surface of the wellbore, through the tubing to said tool and jetted out of said tool in an adjustable manner to perform said fluid pressure wellbore operation.

2. The system of claim 1, wherein the fluid pressure wellbore operation comprises cutting an opening in a casing of the cased wellbore.

3. The system of claim 2, wherein said sensor monitors an operational parameter of the cutting operation and wherein a flowrate of said fluid is adjusted based on the monitored operational parameter in order to maintain a constant pressure on said casing being cut by said fluid.

4. The system of claim 1, wherein the fluid pressure wellbore operation comprises cutting an opening in a casing of the cased wellbore and hydraulically fracturing a formation behind the casing.

5. The system of claim 4, wherein said sensor monitors an operational parameter of the hydraulic fracturing operation to determine an extent of the fracture into the formation.

6. The system of claim 5, wherein the extent is one of a radial extent and a vertical extent of the fracture into the formation.

7. The system of claim 1, wherein the sensor is operationally connected to the surface unit by wireless telemetry.

8. The system of claim 3, wherein the monitored operational parameter is pressure.

9. The system of claim 5, wherein the monitored operational parameter is pressure.

10. A method for maintaining a tool at a desired depth in a cased wellbore while performing a fluid pressure wellbore operation with the tool, the method comprising:

providing a bottomhole assembly (BHA) comprising the wellbore tool, an anchoring device, and a sensor;

connecting the BHA to a coiled tubing;

conveying the BHA on the coiled tubing into the cased wellbore to the desired depth;

obtaining data via the sensor identifying the desired depth, the data transmitted from the sensor to a surface unit;

transmitting a sufficient quantity of fluid from a surface of the wellbore, through the coiled tubing and jetted out of said tool in an adjustable manner to cut an opening in a casing of the cased wellbore and to hydraulically fracture a formation behind said casing; and actuating the anchoring device to engage the casing and maintain the tool at the desired depth during said operating.

11. The method of claim 10, wherein said sensor monitors an operational parameter of said casing cutting operation and wherein a flowrate of said fluid is adjusted based on the monitored operational parameter to maintain a constant pressure on said casing being cut by said fluid.

12. The method of claim 10, wherein said sensor monitors an operational parameter of said fracturing operation to give an indication of the fracture.

13. The method of claim 12, wherein said indication is one of a screen-out, radial fracture extent, vertical fracture extent, and perforation friction.

14. A method for maintaining a tool at a desired depth in a cased wellbore while performing a wellbore operation with the tool, the method comprising:

connecting a bottomhole assembly (BRA) to a coiled tubing;

conveying the BRA by the coiled tubing to the desired depth in the cased wellbore, the BHA comprising the tool, an anchoring device, and a sensor;

transmitting data obtained from the sensor to a surface unit;

transmitting a sufficient quantity of fluid from a surface of the wellbore, through the coiled tubing and jetted out of said tool in an adjustable manner to cut an opening in a casing of the cased wellbore and to hydraulically fracture a formation behind said casing; and actuating the anchoring device to engage the casing and maintain the tool at the desired depth, the data identifying the desired depth and monitoring an operational parameter of said cutting and fracturing operations.

15. The method of claim 10, wherein a flowrate of said fluid is adjusted based on the monitored operational parameter in order to maintain a constant pressure on said casing being cut by said fluid.

16. The method of claim 14, wherein the data is transmitted from the sensor to rhe surface unit by wireless telemetry.

17. The system of claim 14, wherein said sensor monitors an operational parameter of the hydraulic fracturing operation to determine one of a radial extend and a vertical extent of the fracture into the formation.

18. The method of claim 17, wherein the operational parameter is pressure.

* * * * *